US006829841B1

(12) United States Patent
Edwards

(10) Patent No.: US 6,829,841 B1
(45) Date of Patent: Dec. 14, 2004

(54) DRYING CABINET

(76) Inventor: Jonathan G. Edwards, 9980 NC 226 South, Nebo, NC (US) 28761

( * ) Notice: Subject to any disclaimer, the term of this patent is extended or adjusted under 35 U.S.C. 154(b) by 0 days.

(21) Appl. No.: 10/771,976

(22) Filed: Feb. 5, 2004

(51) Int. Cl.[7] ..... F26B 19/00

(52) U.S. Cl. ..... 34/233; 34/84; 34/90; 4/536; 4/601

(58) Field of Search ..... 34/83, 84, 90, 34/232, 233; 4/535, 536, 597, 601

(56) References Cited

U.S. PATENT DOCUMENTS 2,336,402 A * 12/1943 Kaiser ..... 4/601
3,121,235 A * 2/1964 Gellmann ..... 4/570
3,761,989 A 10/1973 Gore
3,772,714 A * 11/1973 Sealby et al. ..... 4/619
4,554,690 A * 11/1985 Knapp et al. ..... 4/601
4,564,963 A 1/1986 Bergmark
4,724,553 A * 2/1988 Bianchi ..... 4/615
4,926,511 A 5/1990 Coll
5,033,131 A 7/1991 Paden
5,468,234 A * 11/1995 Griffin et al. ..... 604/290
5,678,258 A 10/1997 Healy
6,047,416 A 4/2000 Carrier
6,134,722 A * 10/2000 Lowry et al. ..... 4/541.1

* cited by examiner

*Primary Examiner*—Ira S. Lazarus
*Assistant Examiner*—Kathryn S. O'Malley
(74) *Attorney, Agent, or Firm*—Donald R. Schoonover

(57) ABSTRACT

A drying cabinet is used to dry a person's body after bathing or showering. The drying cabinet includes a plurality of adjustable air-dispensing nozzles on two sides and on the rear wall of the cabinet. The nozzles are fluidically connected to each other and to a source of hot dry air by manifolds.

1 Claim, 1 Drawing Sheet

DRYING CABINET

BACKGROUND OF THE INVENTION

1. Field of the Invention

The present invention relates to the general art of showers, and to the particular field of shower enclosures.

2. Discussion of the Related Art

After showering or bathing most people use some sort of towel to dry their body and/or their hair. These towels range from small highly water absorbent towels to large bath sheets.

While toweling is an effective method for drying one's body and/or hair after bathing, toweling has several drawbacks. For example, it may be difficult for some people to reach certain areas of their body using a towel. Furthermore, towels can be bulky and take up a great deal of space. This is an especially onerous drawback if the towel must be transported before and after use, such as may be the case if the towel is carried to or from a health club. The wet towel may be difficult to carry in a gym bag, especially if the towel is used early in the morning and will not be removed until late at night.

Still further, some towels may become mildewed, especially if they are kept in a closed gym bag for extended periods of time.

Furthermore, some towels may irritate a user's skin.

Therefore, there is a need for a means for drying a person after bathing which avoids the use of a towel.

Some bathing areas have high intensity lamps that are intended to dry a person. Such lamps often make a room unduly hot and are not entirely efficient.

Therefore, there is a need for an efficient means for drying a person after bathing.

PRINCIPAL OBJECTS OF THE INVENTION

It is a main object of the present invention to provide a means for drying a person after bathing which avoids the use of a towel.

It is another object of the present invention to provide an efficient means for drying a person after bathing.

SUMMARY OF THE INVENTION

These, and other, objects are achieved by a drying cabinet which has a plurality of air nozzles that direct drying air onto a person standing inside the cabinet. The nozzles are adjustable so a person can control the direction of air flow and people of various heights and sizes can use the cabinet.

Using the drying cabinet embodying the present invention will permit a person to dry his or her body without the use of a towel so all areas of the body will be efficiently dried without irritating the person's skin. The apparatus will efficiently dry an individual without unduly heating areas of a room that may not be amenable to such heating. The drying cabinet embodying the present invention can be used in an individual residence or in a community area. Since air is the only thing that contacts the user, the dryer remains sanitary and clean.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Referring to the Figures, it can be understood that the present invention is embodied in a drying cabinet 10 which is used by a person after bathing or showering to dry off. The person steps into the drying cabinet 10 and is dried by warm dry air.

Figure 2:
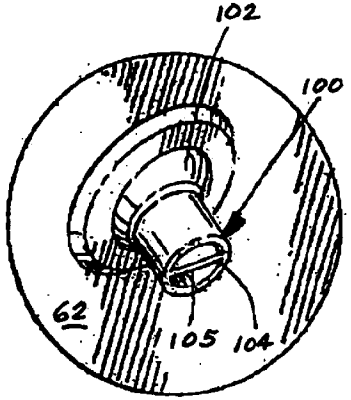
FIG. 2 is a perspective view of an adjustable air nozzle that is located on the rear wall of the drying cabinet.
Figure 1:
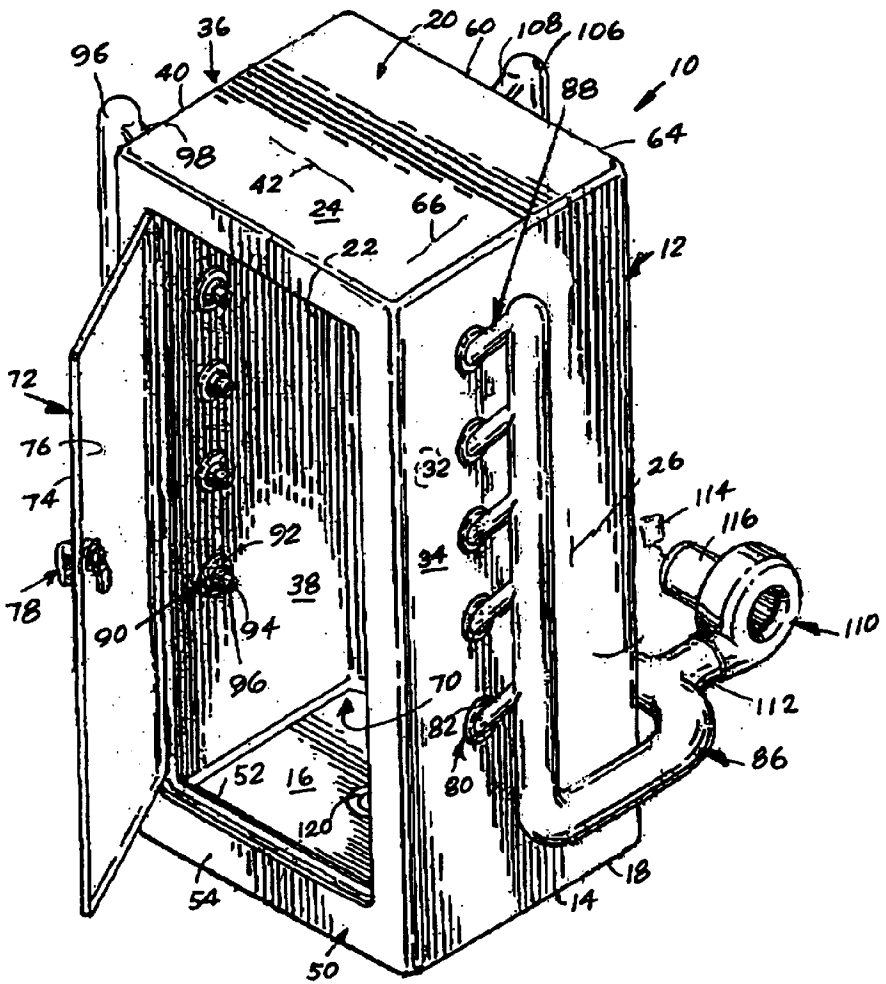
FIG. 1 is a perspective view of a drying cabinet embodying the present invention.

Cabinet 10 comprises a housing 12 which has a first end 14 which is a bottom end when the housing 12 is in a use orientation shown in FIG. 1. First end 14 has an interior surface 16 and an exterior surface 18.

Housing 12 further includes a second end 20 which is a top end when the housing 12 is in the use orientation. The second end 20 has an interior surface 22 and an exterior surface 24.

A longitudinal axis 26 extends between the first end 14 of the housing 12 and the second end 30 of the housing 12.

Housing 12 further includes a first side 30. The first side 30 has an interior surface 32 and an exterior surface 34.

Housing 12 further includes a second side 36. The second side 36 has an interior surface 38 and an exterior surface 40.

A transverse axis 42 extends between the first side 30 and the second side 36 of the housing 12.

Housing 12 further includes a first face 50 which is a front face when the housing 12 is in the use orientation. The first face 50 has an interior surface 52 and an exterior surface 54.

Housing 12 further includes a second face 60 which is a rear face when the housing 12 is in the use orientation. The second face 60 has an interior surface 62 and an exterior surface 64.

A thickness axis 66 extends between the first face 50 of the housing 12 and the second face 60 of the housing 12.

Housing 12 further includes an interior volume 70 defined by the interior surfaces of the first end 14, the second end 20, the first side 30, the second side 36, the first face 50 and the second face 60.

A door 72 is hingeably mounted on the first face 50 of the housing 12 to move between an open condition shown in FIG. 1 and a closed condition. The door 72 includes a first surface 74 which is an outside surface, a second surface 76 which is an inside surface, and a handle 78 which is operable from either the inside surface 76 or the outside surface 74.

A plurality of first air-dispensing nozzles, such as nozzle 80, are adjustably mounted on the first side 30 of the housing 12. The first air-dispensing nozzles 80 are spaced apart from each other in the direction of the longitudinal axis 26 of the housing 12. Each first air-dispensing nozzle 80 includes a pivot connection, such as pivot connection 82, an air-dispensing end (not visible in FIG. 1) and an air deflector (not visible in FIG. 1) located adjacent to the air-dispensing end.

A first air manifold 86 fluidically connects each of the first air-dispensing nozzles 80 together. First air manifold 86 is located outside the housing 12 and adjacent to the exterior surface 32 of the first side 30 of the housing 12 and includes a connection conduit, such as connection conduit 88, for each air-dispensing nozzle 80.

A plurality of second air-dispensing nozzles, such as air-dispensing nozzle 90, are adjustably mounted on the second side 36 of the housing 12. All of the air-dispensing nozzles of cabinet 10 are identical, therefore, the nozzles not visible in FIG. 1 are identical to the nozzles that are visible in FIG. 1. The second air-dispensing nozzles 90 are spaced apart from each other in the direction of the longitudinal axis 26 of the housing 12. Each second air-dispensing nozzle 90 includes a pivot connection 92, an air-dispensing end 94, and an air deflector 96 located adjacent to the air-dispensing end 94.

A second air manifold 96 fluidically connects each of the second air-dispensing nozzles 90 together. The second air manifold 96 is located outside the housing 12 and adjacent to the exterior surface 40 of the second side 36 of the housing 12 and includes a connection conduit, such as connection conduit 98, for each air-dispensing nozzle 90.

A plurality of third air-dispensing nozzles, such as air-dispensing nozzle 100, are adjustably mounted on the second face 60 of the housing 12. The third air-dispensing nozzles 100 are spaced apart from each other in the direction of the longitudinal axis 26 of the housing 12. Each third air-dispensing nozzle 100 includes a pivot connection 102, an air-dispensing end 104, and an air deflector 105 located adjacent to the air dispensing end 104.

A third air manifold 106 fluidically connects each of the third air-dispensing nozzles 100 together. The third air manifold 106 is located outside the housing 12 and adjacent to the exterior surface 64 of the second face 60 of the housing 12 and includes a connection conduit, such as connection conduit 108, for each air-dispensing nozzle 100.

A source of heated air, such as air pump 110, is fluidically connected by an exhaust conduit 112 to the first air manifold 86 and to the second air manifold 96 and to the third air manifold 106 to direct air into the interior volume 70 of the housing 12 via the manifolds 86, 96, 106 and via the air-dispensing nozzles 80, 90, 100. Air from a heated source 114 is fluidically connected to the pump 110 by a conduit 116.

A drain 120 is located in the first end 14 of the housing 12 and is fluidically connected to a waste water collection system, such as a drain of a shower to conduct water that falls off of a person using the cabinet.

It is understood that while certain forms of the present invention have been illustrated and described herein, it is not to be limited to the specific forms or arrangements of parts described and shown.

What is desired to be secured by Letters Patent is as follows:

1. A drying cabinet comprising:

a) a housing having (1) a first end which is a bottom end when said housing is in a use orientation, the first end having an interior surface and an exterior surface, (2) a second end which is a top end when said housing is in the use orientation, the second end having an interior surface and an exterior surface, (3) a longitudinal axis extending between the first end of said housing and the second end of said housing, (4) a first side, the first side having an interior surface and an exterior surface, (5) a second side, the second side having an interior surface and an exterior surface, (6) a transverse axis extending between the first side and the second side, (7) a first face which is a front face when said housing is in the use orientation, the first face having an interior surface and an exterior surface, (8) a second face which is a rear face when said housing is in the use orientation, the second face having an interior surface and an exterior surface, (9) a thickness axis extending between the first face of said housing and the second face of said housing,

(10) an interior volume defined by the interior surfaces of the first end, the second end, the first side, the second side, the first face and the second face, and

(11) a door hingeably mounted on the first face of said housing to move between an open condition and a closed condition, the door including a first surface which is an outside surface, a second surface which is an inside surface and a handle which is operable from either the inside surface or the outside surface;

b) a plurality of first air-dispensing nozzles adjustably mounted on the first side of said housing, said first air-dispensing nozzles being spaced apart from each other in the direction of the longitudinal axis of said housing, each first air-dispensing nozzle including a pivot connection, an air-dispensing end, and an air deflector located adjacent to the air-dispensing end;

c) a first air manifold fluidically connecting each of said first air-dispensing nozzles together, said first air manifold being located outside said housing and adjacent to the exterior surface of the first side of said housing, said first air manifold having a connection conduit associated with each first air-dispensing nozzle;

d) a plurality of second air-dispensing nozzles adjustably mounted on the second side of said housing, said second air-dispensing nozzles being spaced apart from each other in the direction of the longitudinal axis of said housing, each second air-dispensing nozzle including a pivot connection, an air-dispensing end, and an air deflector located adjacent to the air-dispensing end;

e) a second air manifold fluidically connecting each of said second air-dispensing nozzles together, said second air manifold being located outside said housing and adjacent to the exterior surface of the second side of said housing, said second air manifold having a connection conduit associated with each second air-dispensing nozzle;

f) a plurality of third air-dispensing nozzles adjustably mounted on the second face of said housing, said third air-dispensing nozzles being spaced apart from each other in the direction of the longitudinal axis of said housing, each third air-dispensing nozzle including a pivot connection, an air-dispensing end, and an air deflector located adjacent to the air-dispensing end;

g) a third air manifold fluidically connecting each of said third air-dispensing nozzles together, said third air manifold being located outside said housing and adjacent to the exterior surface of the second face of said housing, said third air manifold having a connection conduit associated with each third air-dispensing nozzle;

h) a source of heated air which is fluidically connected to said first air manifold and to said second air manifold and to said third air manifold; and i) a drain located in the first end of said housing.

* * * * *